US010246923B2

(12) United States Patent
Bortoluzzi et al.

(10) Patent No.: US 10,246,923 B2
(45) Date of Patent: Apr. 2, 2019

(54) DAMPING OR RETURN DEVICE FOR SLIDING DOOR LEAVES OR FOR DRAWERS

(71) Applicant: BORTOLUZZI SISTEMI S.P.A., Belluno (IT)

(72) Inventors: Guido Bortoluzzi, Belluno (IT); Adriano Girotto, Spresiano (IT); Lucio Moliner, Santa Giustina (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

(21) Appl. No.: 15/525,684

(22) PCT Filed: Nov. 6, 2015

(86) PCT No.: PCT/EP2015/075975

§ 371 (c)(1),
(2) Date: May 10, 2017

(87) PCT Pub. No.: WO2016/075051

PCT Pub. Date: May 19, 2016

(65) Prior Publication Data

US 2017/0321465 A1 Nov. 9, 2017

(30) Foreign Application Priority Data

Nov. 11, 2014 (IT) ..... MI2014U0345

(51) Int. Cl.

| | |
|---|---|
| ***E05F 5/06*** | (2006.01) |
| ***E05F 5/00*** | (2017.01) |
| ***E05F 5/02*** | (2006.01) |

(52) U.S. Cl.
CPC ..... *E05F 5/003* (2013.01); *E05F 5/02* (2013.01); *E05F 5/027* (2013.01);
(Continued)

(58) Field of Classification Search
CPC ..... Y10T 16/61; Y10T 16/625; Y10T 16/628; Y10T 16/6285; Y10T 16/5383; E05F 3/00;
(Continued)

(56) References Cited

U.S. PATENT DOCUMENTS 2,496,691 A 2/1950 Petzer
3,346,993 A * 10/1967 Johnson ..... E05D 15/066 16/320
(Continued)

FOREIGN PATENT DOCUMENTS

DE 20201003575 U1 7/2010
EP 1658785 A1 5/2006
(Continued)

OTHER PUBLICATIONS

Written Opinion and Search Report of International Application No. PCT/EP2015/075978 dated Feb. 2, 2016; 10 pages.

*Primary Examiner* — Chuck Y Mah
(74) *Attorney, Agent, or Firm* — Brooks Kushman P.C.

(57) ABSTRACT

A damping or return device for sliding door leaves, particularly for furniture, or for drawers, which is constituted by a pin the shank of which is constituted by a diametrically differently-polarized magnet that slideably and axially interacts with a steel plate or a complementarily-shaped collar, which is made of steel and polygonal.

20 Claims, 7 Drawing Sheets

(52) U.S. Cl.
CPC ..... *E05Y 2201/46* (2013.01); *E05Y 2900/132* (2013.01); *E05Y 2900/20* (2013.01)

(58) Field of Classification Search
CPC ..... E05F 3/003; E05F 3/02; E05F 3/06; E05F 3/08; E05F 3/10; E05F 3/14; E05F 3/16; E05F 3/18; E05F 3/20; E05F 3/102; E05F 5/00; E05F 5/003; E05F 5/02; E05F 5/06; E05F 5/006; E05F 5/08; E05F 5/10; E05F 5/022; E05Y 2900/54; E05Y 2900/548; E05Y 2201/21; E05Y 2201/254; E05Y 2201/256; E05Y 2201/264; E05Y 2201/266; E05Y 2201/412; E05Y 2201/46; E05Y 2201/47; E05Y 2201/474; E05Y 2600/456; E05Y 2900/20
See application file for complete search history.

(56) References Cited

U.S. PATENT DOCUMENTS 6,167,589 B1 * 1/2001 Luedtke ..... E05F 1/00 16/49
6,932,200 B2 * 8/2005 Booker ..... F16F 9/0218 188/300
8,910,345 B2 * 12/2014 Bland ..... E05F 1/00 16/71
2002/0010977 A1 * 1/2002 Salice ..... E05F 5/02 16/49
2002/0170794 A1 * 11/2002 Dubach ..... E05F 5/10 188/381
2003/0200625 A1 * 10/2003 Zimmer ..... E05F 5/006 16/306
2003/0213663 A1 * 11/2003 Salice ..... E05F 5/02 188/284
2007/0171732 A1 * 7/2007 Lin ..... B82Y 10/00 365/189.14
2010/0170062 A1 * 7/2010 Kim ..... E05F 5/10 16/52
2011/0283478 A1 * 11/2011 Berry ..... E05F 5/02 16/54
2012/0110914 A1 * 5/2012 Salice ..... F16F 9/19 49/386
2013/0155033 A1 * 6/2013 Jin ..... G09G 3/3266 345/204

FOREIGN PATENT DOCUMENTS

EP 2330269 A2 6/2011
EP 2455571 A1 5/2012
EP 2557259 A2 2/2013
EP 2016075050 A1 5/2016
EP 2016083217 A1 6/2016
WO 2014180729 A1 11/2014

* cited by examiner

DAMPING OR RETURN DEVICE FOR SLIDING DOOR LEAVES OR FOR DRAWERS

CROSS-REFERENCE TO RELATED APPLICATIONS

This application is the U.S. national phase of PCT Application No. PCT/EP2015/075975 filed on Nov. 6, 2015, which claims priority to Italian Patent Application No. MI2014U000345 filed on Nov. 11, 2014, the disclosures of which are incorporated in their entirety by reference herein.

TECHNICAL FIELD

The present invention relates to a damping or return device for sliding door leaves, of the type with co-planar closure or otherwise, particularly for furniture and the like, or for drawers.

BACKGROUND

Nowadays as an alternative to usual, hinged doors, solutions are known for sliding doors that can be applied both to wardrobes and pieces of furniture in general, and also to door and window frames or to any other application of closing elements that require a reduced space when open.

Usually such types of door are constituted by one or more door leaves, each one of which has brackets with rolling means that are guided by a rail, which is constituted by an upper guide and by a lower guide, which respectively are applied to the ceiling and optionally to the floor of the compartment to be closed.

It is known to fit the door leaf with a device to return it to the open position, which can be disengaged as needed when it is desired to close the sliding door, or to the closed position, when it is desired that the door leaf follow a guided closure.

A problem that is found in conventional sliding door leaves is constituted by the fact that the door leaf can remain partially closed or partially open or it can slam, on the jambs of the door or on the sides of the item of furniture, when the door leaf is completely opened or completely closed.

Similar observations can be made for drawers.

A partial solution to such drawback is known from EP1658785 which discloses a device that is adapted to assist and guide the movement of a door leaf, which comprises a receptacle inside which is placed a damper, a spring, and an entrainment element that can be accommodated within a pair of teeth that are associated with a coupling element which comprises a guiding pin that can slide into an upturned L-shaped guide.

The device is arranged proximate to one end of the compartment.

For example, when opening the door leaf, at a certain point the device hooks the entrainment element that activates the damper until the pin is positioned, through the L-shaped guide, in a stable and stationary condition: when the door leaf is closed, the entrainment element interacts with the pair of teeth and activates the damper which thus gently accompanies the door up until the condition where it is completely closed.

Such solution however suffers some drawbacks: the device is in fact complex in terms of construction in that it is constituted by a plurality of elements that have to be put together in advance while paying great attention to the elements of play that exist for example between the L-shaped guide and the pin that rests in it, since any sticking or the creation of friction could defeat the operation of the device and thus prevent the correct closing or complete opening of the door leaf.

Furthermore, conventional return devices suffer other criticalities which are linked to the fact that the return spring does not have a constant force along its stroke.

This causes problems with the return along the final part of the stroke because the force is low and there are, inversely, problems with opening the door in the final part when the door is released, where the force of the spring is too high.

This, combined with the fact that the connection to the return mechanism of the door in motion occurs by way of mechanical means, creates bothersome noise in operation.

EP 2455571 is also known, which discloses a mechanism for forcible movement which comprises a first urging body to apply a force toward a certain position for a fixed body in a standby position.

A striker body is captured at a prescribed position by the fixed body which is held in standby position, and a movable body is moved up to a position at end of movement by way of the relative movement of the fixed body to the determined position by the release of the hold on the occasion of the capture.

A damping mechanism comprises a contact part for connection with the fixed body constituting the mechanism for forcible movement, a second body urging the contact part in an advancement direction.

The damping mechanism is constituted so as to apply a resistance to a retraction of the contact part accompanying the movement of the fixed body to the determined position.

Such solution suffers the same drawbacks mentioned previously.

EP 2557259 is also known, which discloses a braking device that comprises pneumatic braking means which can be activated by way of a slider interacting with a fixed frame, for example of the door, in one embodiment there is a piston the rod of which is provided, at the end tip, with a magnetic head the function of which is, once it has come into contact with a fixed L-shaped profile with one wing positioned head-on to the magnetic head, to allow the rod to be extracted from the stem of the piston.

Such solution suffers many drawbacks such as the considerable length required for the braking device, the stem of which is subject to possible breakage or sticking; furthermore, the reliability of the pneumatic functionality is poor.

Finally the sole function of the magnetic head is to directly couple to a fixed body, arranged along the same axis, for the extraction of the stem.

EP 2330269 is also known, which discloses a sliding guide for doors of wardrobes which has a damper stop comprising a trolley consisting of a first frame and a second frame shaped like an upturned "U" to which the upper ends of an outer or inner door are fixed.

The damper stop comprises an air or gas damper fixed outside two seats which are provided on a section associated with the trolley.

Such solution also suffers many drawbacks, such as the use of a gas damper which, moreover, is arranged laterally to the trolley so as to increase the space taken up and render the guide barely usable.

The aim of the present invention is therefore to resolve the above mentioned technical problems, by eliminating the drawbacks in the cited known art and hence providing an invention, which can be applied to sliding doors or door leaves or to drawers, which has a simple structure, which is free from sticking and which makes it possible to obtain the optimal closing and guided opening of the door or of the door leaf, while preventing the same from slamming against the wall of the item of furniture.

Within this aim, another important object of the invention is to provide a device that is easily applied to conventional door leaves or to conventional doors of furniture.

Another object is to provide a device the dimensions and weight of which are contained and which therefore is low cost.

Another object of the invention is to provide a device by which it is possible to contain the friction and elements of play in the various movements, thereby optimizing the movement and the sliding of the door leaf.

Another object is to provide an invention that is free from bothersome noises during its operation.

This aim and these and other objects which will become better apparent hereinafter are achieved by a damping or return device for sliding door leaves, particularly for furniture, or for drawers, which is characterized in that it is constituted by a pin the shank of which is constituted by a diametrically differently-polarized magnet that slideably and axially interacts with a steel plate or a complementarily-shaped collar, which is made of steel and polygonal in cross-section, in contrast with an elastically compressible element.

BRIEF DESCRIPTION OF THE DRAWINGS

Further characteristics and advantages of the invention will become better apparent from the detailed description of a particular, but not exclusive, embodiment, which is illustrated by way of non-limiting example in the accompanying drawings wherein.

DETAILED DESCRIPTION

Figures 1, 2:
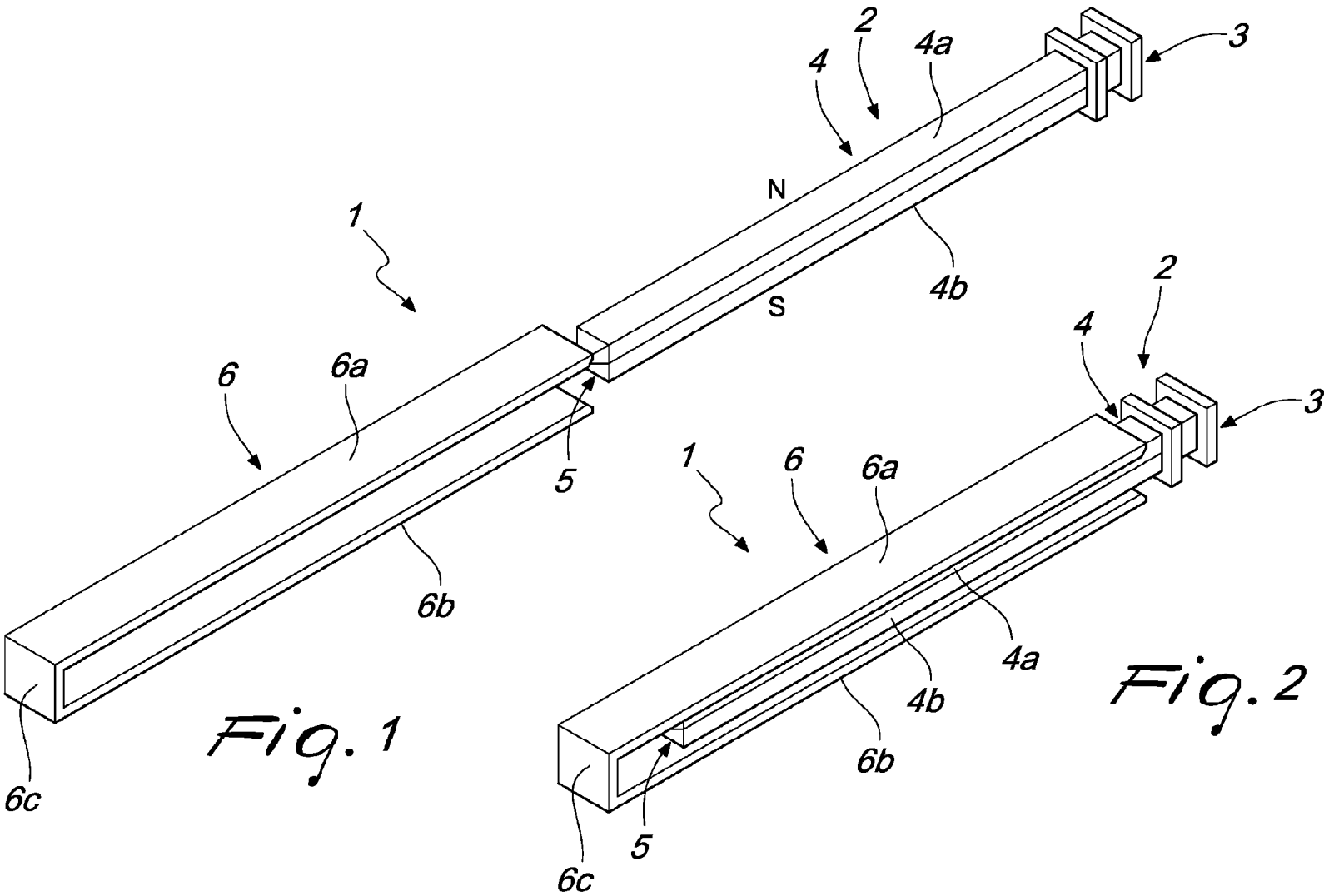
FIG. 1 is a perspective exploded view of a device according to the invention.
FIG. 2 is a perspective view of the device of FIG. 1.
Figure 3:
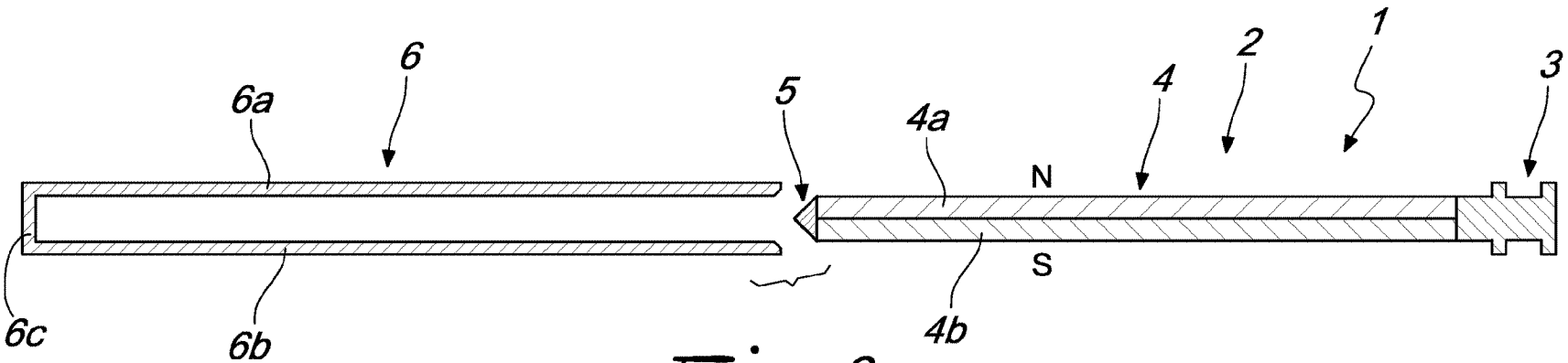
FIG. 3 is a cross-sectional view of the device of FIG. 1.
Figure 4:
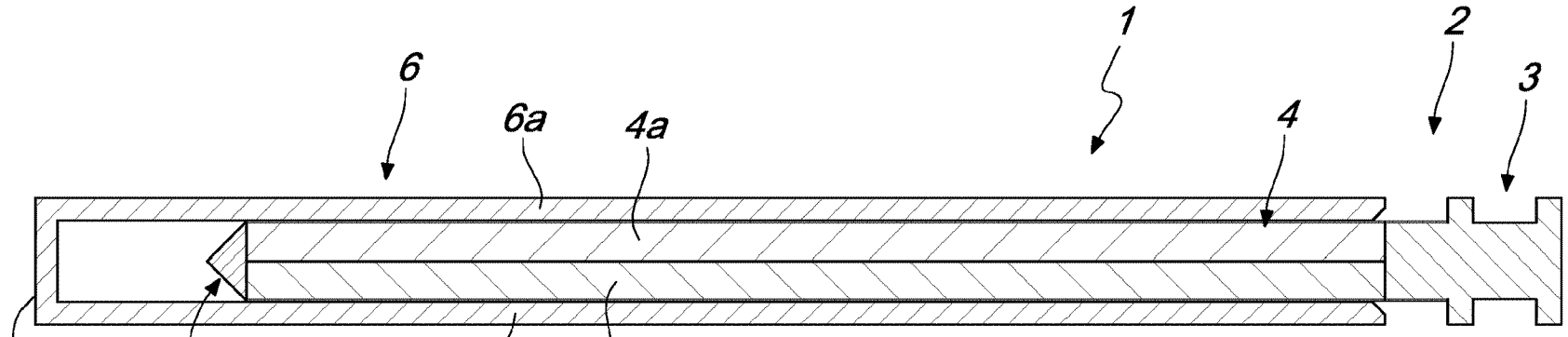
FIG. 4 is a cross-sectional view of the device of FIG. 2.

In the embodiments illustrated, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

With reference to the figures, the reference numeral 1 generally designates a device that is associated with a slideable door leaf, particularly for furniture and the like, or for drawers (not shown).

The device 1 is constituted by a pin 2 with a first head 3 which is polygonal, preferably square, in plain view with a H-shaped transverse cross-section, from which a polygonal, preferably square or rectangular, shank 4, diametrically polarized differently, protrudes axially, the end tip 5 of which is substantially V-shaped or rounded.

The shank 4 of the pin 2 is diametrically polarized differently: it is therefore, from the magnetic point of view, divided into a first half-shank 4*a* and a second half-shank 4*b*, which are coupled together and are mutually identical, are polygonal, preferably rectangular, in cross-section and have opposing polarities.

For example the first half-shank 4*a* has a north polarity N and the second half-shank 4*b* has a south polarity S.

Also going to make up the device 1 is a steel plate 6 which is C-shaped in cross-section so as to define a first wing 6*a* and a second wing 6*b* which, when the device is activated, are arranged facing toward, without contact, the half-shank 4*a* and the half-shank 4*b*.

The first wing and the second wing 6*a*, 6*b* therefore have dimensions and encumbrances which are such as to accommodate between them, without contact, the shank 4 of the pin 2 which can thus slide freely without sliding friction.

The plate 6 has a base 6*c* connecting the first wing and the second wing 6*a*, 6*b*.

The shank 4 of the diametrically differently-polarized pin 2 moves in contrast with a damping element 7 which is constituted for example by a spring arranged inside the steel plate 6.

Figures 5, 6, 7:
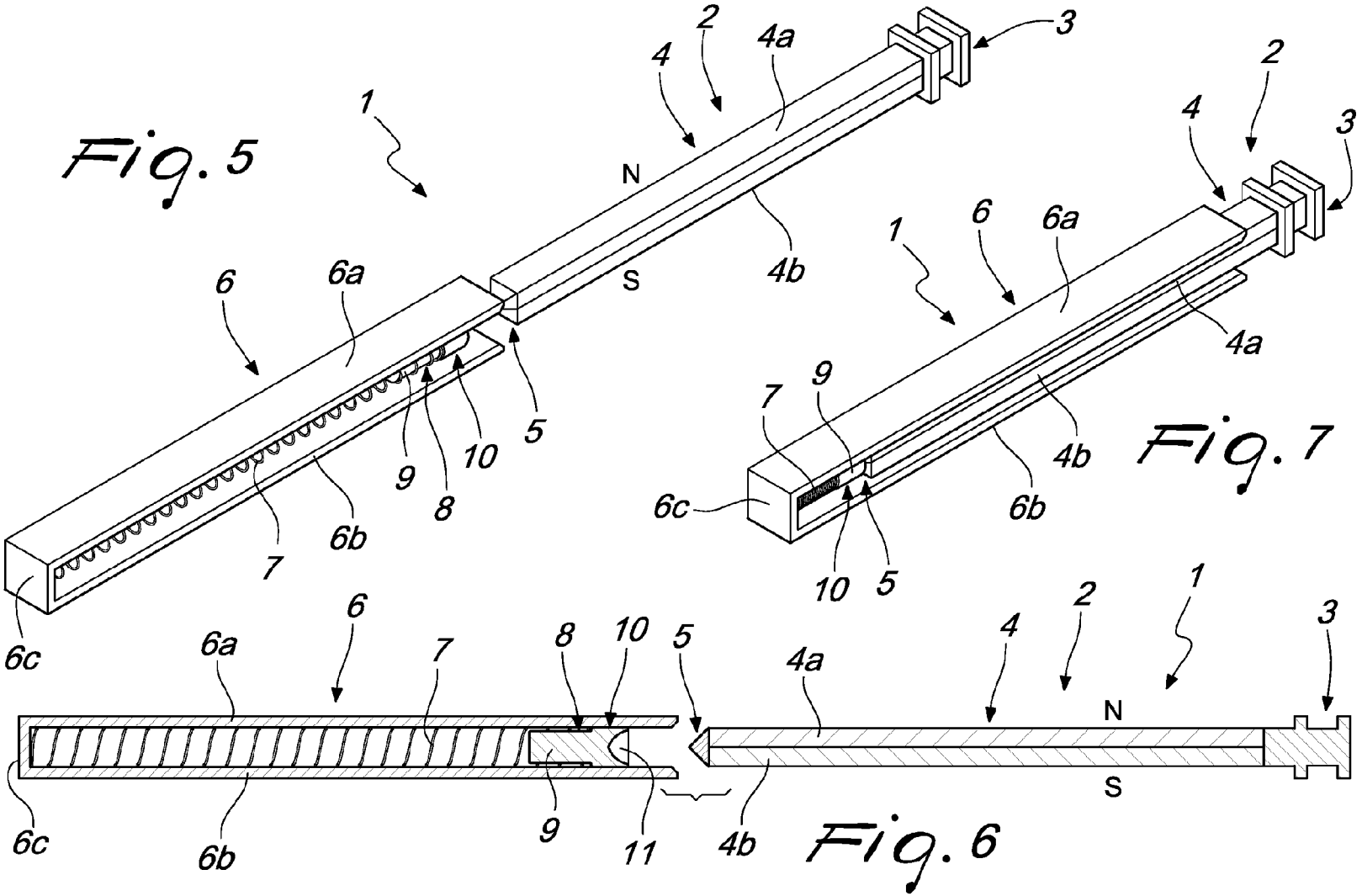
FIG. 5 is a view of a device which is similar to the view in FIG. 1 in which there is a damping element.
FIG. 6 is a view of the device which is similar to the view in FIG. 4 in which there is a damping element arranged inside the plate.
FIG. 7 is a view of the device which is similar to the view in FIG. 5 with the damping element compressed.
Figure 8:
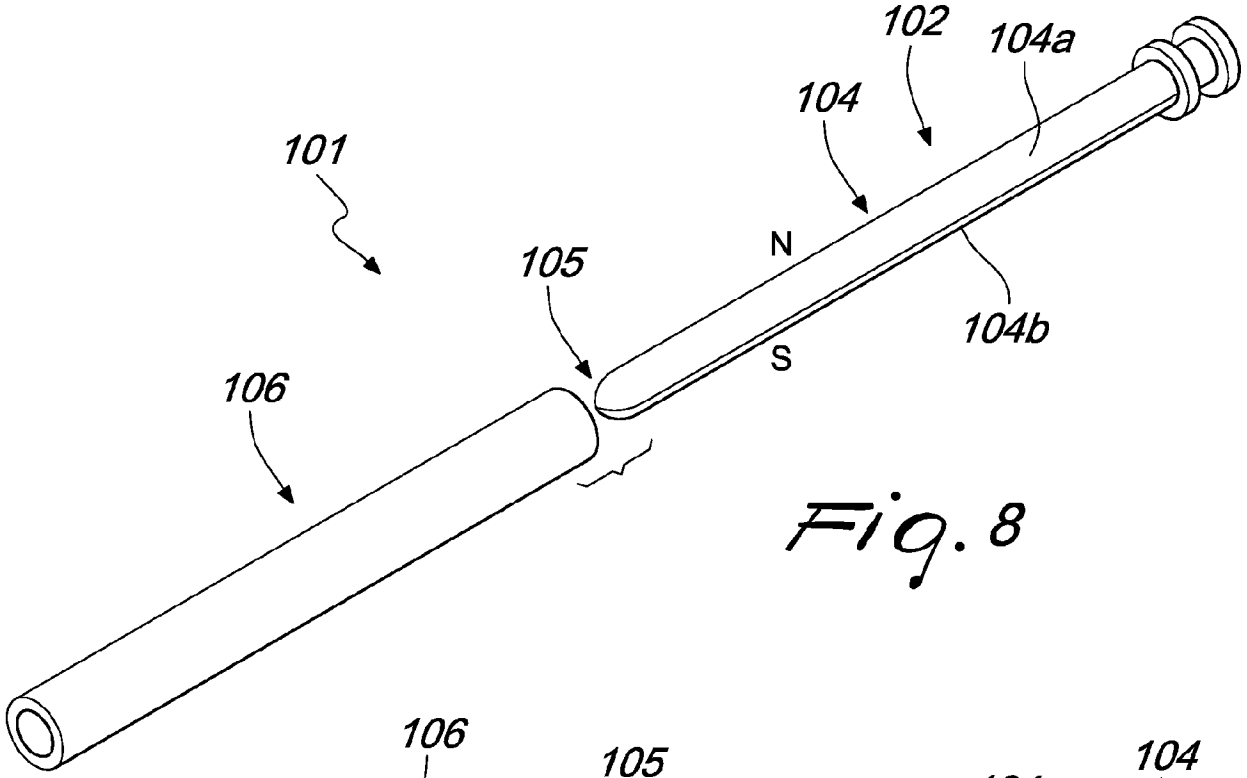
FIG. 8 is a perspective view of a different embodiment of the device according to the invention.
Figure 9:
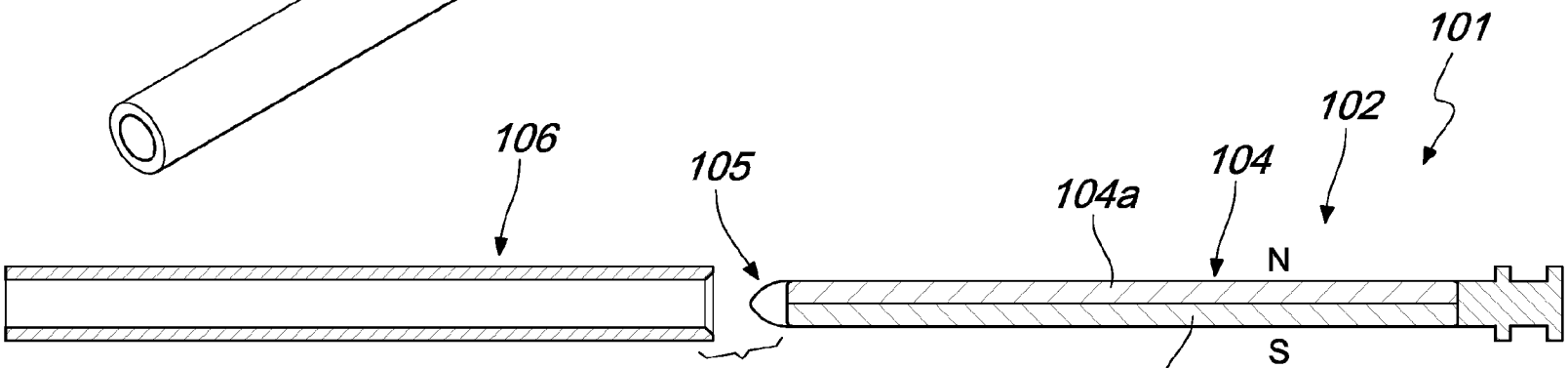
FIG. 9 is a view of the device of FIG. 8 which is similar to the view in FIG. 3.
Figure 10:
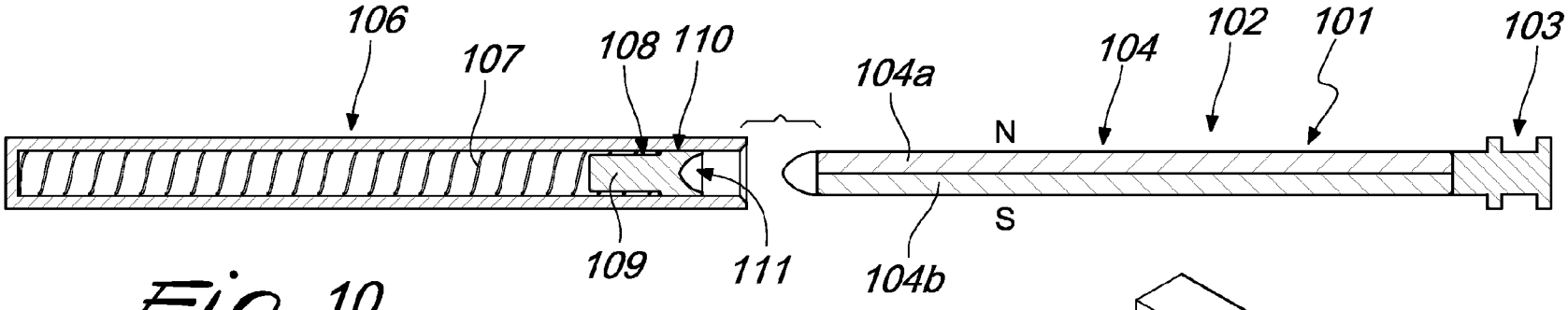
FIG. 10 is a view of the device of FIG. 8 which is similar to the view in FIG. 6.
Figure 11:
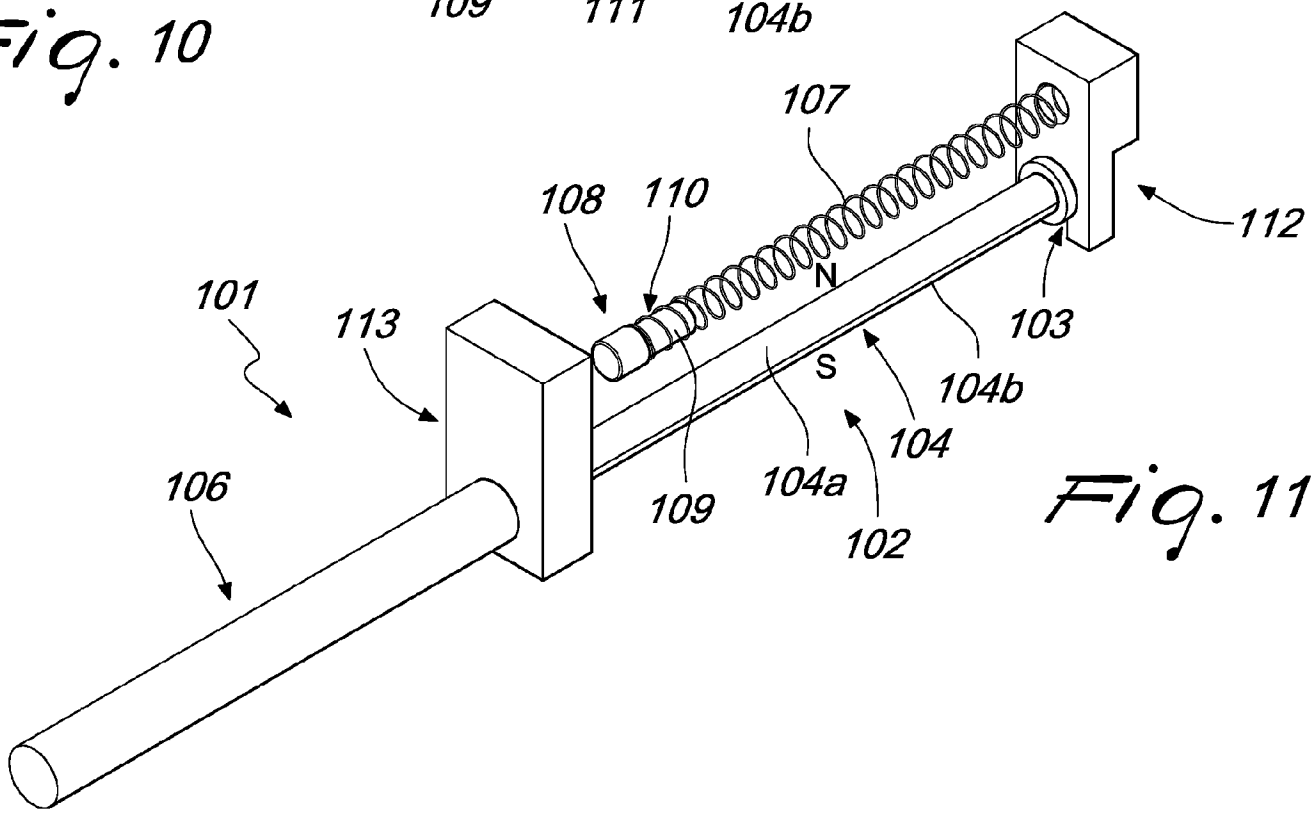
FIG. 11 is a perspective view of a further embodiment of the device according to the invention.
Figure 12:
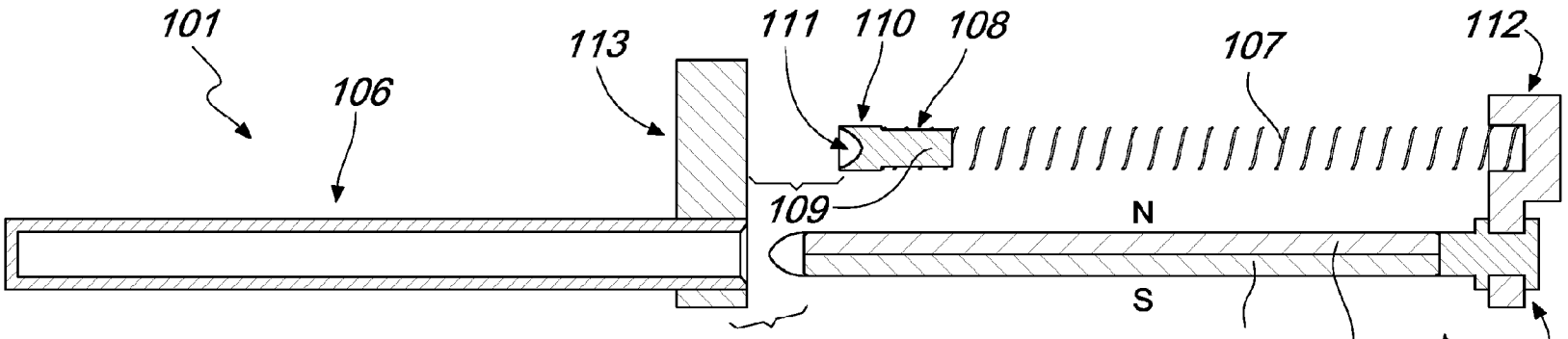
FIG. 12 is a cross-sectional view of the device in FIG. 11.
Figure 13:
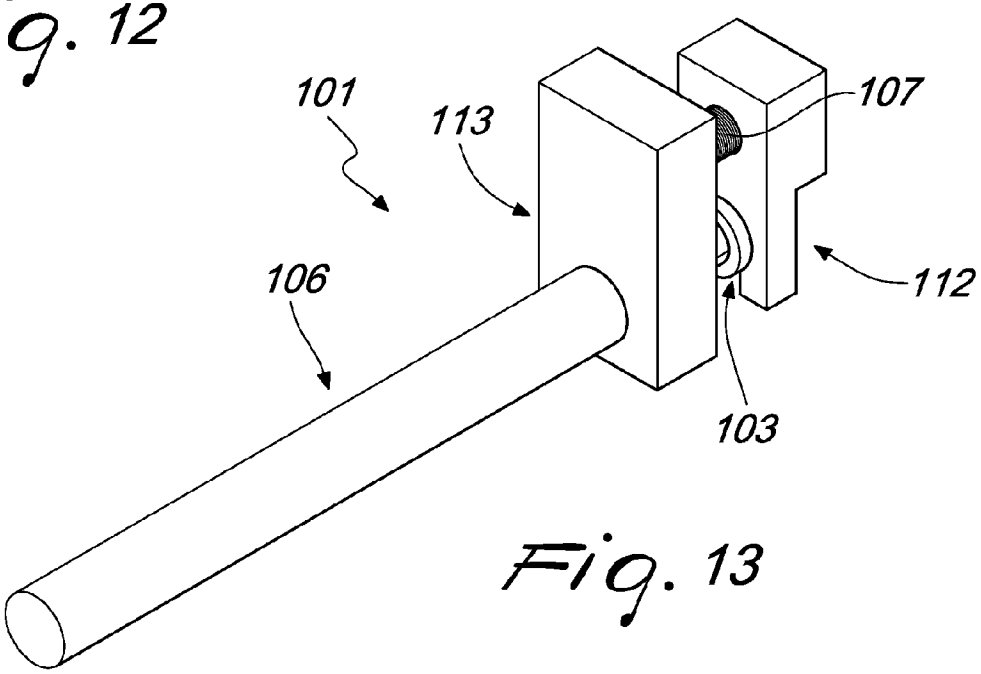
FIG. 13 is a view of the device which is similar to the view in FIG. 11 with the damping element compressed.
Figure 14:
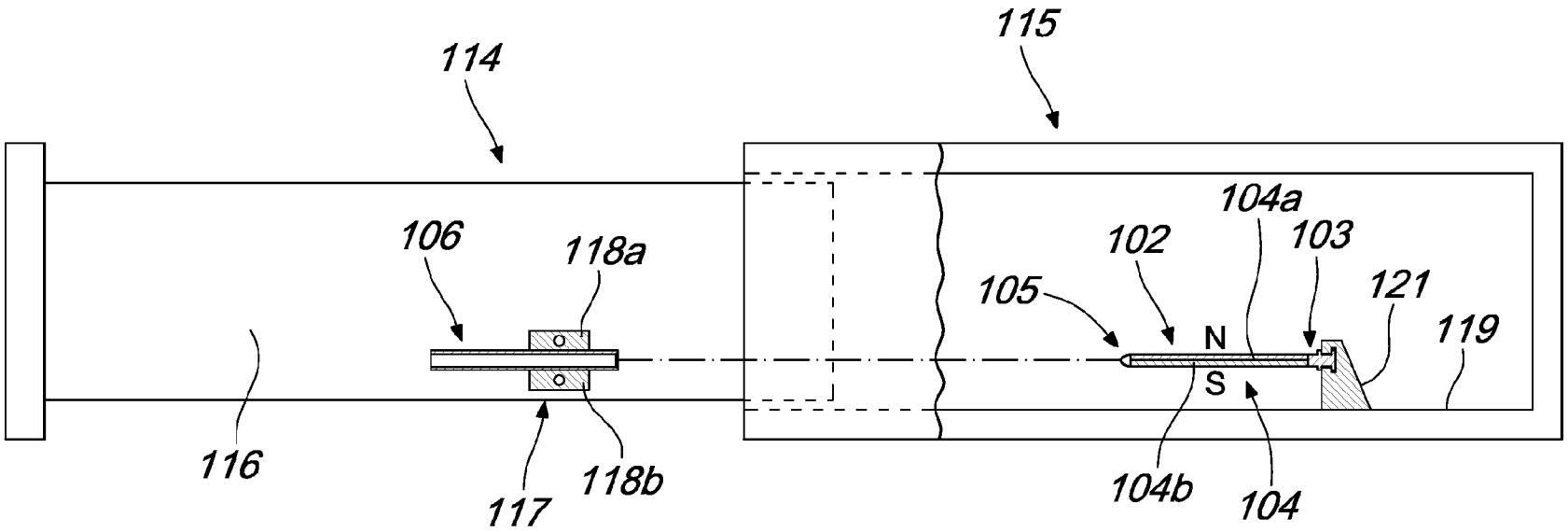
FIG. 14 is a side view of the device, cross-sectioned, applied to a drawer.

In the embodiment shown in FIG. 5 the damping element 7 is arranged between the first wing and the second wing 6*a*, 6*b*; advantageously the length of the damping element 7 is shorter than that of the plate 6.

At the end 8 of the damping element 7 directed toward the end tip 5 of the pin 2, the complementarily-shaped shank 9 of an insert 10 which can slide between the first wing and the second wing 6*a*, 6*b* is axially inserted.

The insert 10 advantageously has a second head 11 which is shaped complementarily to the end tip 5 of the pin 2 in order to facilitate the mutual coupling.

As an alternative to the plate 6, a device 101 is shown which uses a collar 106, also made of steel, and polygonal, preferably cylindrical, in cross-section, which is shaped complementarily to the substantially cylindrical shank 104 of a pin 102 which is diametrically polarized differently so as to define a first half-shank 104*a* and a second half-shank 104*b*.

The shank 104 optionally operates in contrast with a damping element 107 at the end 108 of which that is directed toward the end tip 105 of the pin 102 the complementarily-shaped shank 109 of an insert 110 which can slide within the collar 106 is axially inserted.

The insert 110 advantageously also has a second head 111 which is shaped complementarily to the end tip 105 of the pin 102 in order to facilitate the mutual coupling.

Alternatively, the damping element 107 is associated with and protrudes at right angles from a first appendage 112 which is in turn associated with and protrudes radially from the first head 103 of the pin 102.

The damping element 107 is arranged substantially parallel to the shank 104 in the direction of the free end 105 of the shank 104.

The free end 108 of the damping element 107 interacts in abutment with a second appendage 113 which protrudes radially from the collar 106.

Operation of the device is as follows: after having obtained the diametrically differently-polarized pin 2, 102, in the final stage of closing a door leaf, with which the pin 2, 102 is associated, the shank 4, 104 penetrates inside the plate 6 or inside the collar 106 and is kept in axial alignment by it without there being sliding friction.

The end tip 5, 105 of the shank 4, 104 then interacts with the damping element 7, 107, if present, which slows the stroke thereof until it is stopped at the desired point when it reaches its stroke limit, optimally and continuously, and exerting a force that is constant both during closing and during opening.

The presence of the insert 10, 110 makes it possible to improve the sliding of the spring inside the collar and improve the compression and elongation phase of that spring.

If the device 101 is to be applied to a drawer 114 of the type with usual and conventional rails, not shown, for the sliding thereof with respect to a frame 115 of an item of furniture, it will be sufficient for the collar 106 to be associated with at least one of the outer lateral surfaces 116 of the drawer 114 by way of a first bracket 117 shaped like an Ω (omega) which is fixed with screws at perforated wings 118*a*, 118*b* to the lateral surface 116.

The pin 102 on the other hand is arranged parallel to a bottom 119 of the frame 115, at a height such as to bring it into axial alignment with the collar 106, by way of a second bracket 121 which is provided with means of coupling which are shaped complementarily to the head 103 of the pin 102.

In practice it has been found that the invention has fully achieved the intended aim and objects, a device being obtained that can be applied to sliding doors or door leaves or to drawers, including existing doors or door leaves or drawers, and is provided with a simple structure that, partly thanks to the use of the diametrically differently-polarized collar, is free from the presence of sliding friction between components and from sticking, thus making it possible to achieve the optimal guided closing and opening of the door or of the door leaf while preventing the same from slamming on the wall of the item of furniture.

Furthermore, the weight and dimensions and cost of the device are contained, while at the same time making it possible to contain the friction and elements of play in the various movements, so as to optimize the movement and the sliding of the door leaf or of the drawer.

Obviously the materials used as well as the dimensions of the individual components of the invention may be more relevant according to specific requirements.

The various means of achieving certain different functions certainly need not coexist only in the embodiment shown, but may be present in many embodiments, even if they are not shown.

The characteristics indicated above as advantageous, convenient or the like, may also be missing or be substituted by equivalent characteristics.

The disclosures in Italian Utility Model Application No. MT2014U000345 (202014902308352) from which this application claims priority are incorporated herein by reference.

The invention claimed is:

1. A damping or return device for sliding door leaves or for drawers, comprising:

a pin having a shank constituted by a diametrically differently-polarized magnet that comprises mutually coupled first and second portions having opposing polarities;

at least one of a steel plate or a complementarily-shaped steel collar polygonal in cross-section, wherein the pin slideably and axially interacts with the steel plate or collar; and an elastically compressible element arranged to damp movement of the pin as the pin moves in contrast with the elastically compressible element.

2. The device according to claim 1, wherein the pin has a first head which is polygonal in plan view with a H-shaped transverse cross-section, from which the shank, diametrically polarized differently, and substantially square or rectangular, protrudes axially, an end tip of which is V-shaped or rounded.

3. The device according to claim 2, wherein an end of the elastically compressible element has an insert which can slide, the insert having a second head which is shaped complementarily to the end tip of the pin.

4. The device according to claim 1, wherein the pin has a first head which is polygonal in plan view with a H-shaped transverse cross-section, from which the shank, diametrically polarized differently, and substantially circular, protrudes axially, an end tip of which is V-shaped or rounded.

5. The device according to claim 2, wherein the shank of the pin is diametrically polarized differently and is therefore, from the magnetic point of view, divided into a first half-shank and a second half-shank, which are coupled together and are mutually identical, being polygonal in cross-section and having opposing polarities, the first half-shank having a north polarity and the second half-shank having a south polarity.

6. The device according to claim 5, wherein the steel plate is C-shaped in cross-section so as to define a first wing and a second wing which, when the pin interacts with the steel plate, are arranged facing toward, without contact, the first half-shank and the second half-shank, the first wing and the second wing spaced apart a dimension to accommodate between them, without contact, the shank of the pin which can thus slide freely without sliding friction, the plate having a base connecting the first wing and the second wing.

7. The device according to claim 4, wherein the elastically compressible element is associated with and protrudes at right angles from a first appendage which is in turn associated with and protrudes radially from the first head of the pin, the elastically compressible element being arranged substantially parallel to the shank in the direction of the end tip of the shank, the end tip of the elastically compressible element interacting in abutment with a second appendage which protrudes radially from the collar.

8. The device according to claim 4, wherein the complementarily-shaped collar is associated with at least one outer lateral surface of a drawer of the type with rails for the sliding thereof with respect to a frame of an item of furniture, the complementarily-shaped collar being associated with the at least one outer lateral surface by way of a first bracket shaped like an Ω (omega) which is fixed with screws at perforated wings to the lateral surface, the pin being arranged parallel to a bottom of the frame, at a height such as to bring it into axial alignment with the complementarily-shaped collar, by way of a second bracket which is provided with means of coupling which are shaped complementarily to the first head of the pin.

9. The device according to claim 1, wherein the elastically compressible element comprises a spring.

10. The device according to claim 1, wherein the elastically compressible element, the length of which is shorter than that of the plate or collar, is arranged to move without sliding friction.

11. A damping device for sliding door leaves or for drawers, comprising:

a pin with an elongated shank, wherein the shank is formed of first and second magnet portions coupled diametrically opposite each other and having opposing polarities;

a steel collar having an opening for slideably receiving the elongated shank; and an elastically compressible element arranged to damp movement of the pin as the pin is slideably received in the opening on the steel collar.

12. The device according to claim 11, wherein the pin has a first head which protrudes from the elongated shank and has a at least one of a square, rectangular or circular cross-section.

13. The device according to claim 11, wherein the elongated shank has an end tip having an end tip shape being at least one of a V-shape or a rounded-shape and an end of the elastically compressible element has an insert shaped complementarily to engage the end tip of the elongated shank.

14. The device according to claim 11, wherein the elongated shank has a polygonal cross-section.

15. The device according to claim 11, wherein the opening is defined by steel collar and has a polygonal cross-section.

16. The device according to claim 11, wherein the steel collar is defined by a plate having a first wing and a second wing connected by a base, the first wing and the second wing spaced apart a distance to define the opening that receives the elongated shank without contact so to the elongated shank can slide freely without sliding friction.

17. The device according to claim 11, wherein the elastically compressible element comprises a spring being shorter than the collar.

18. The device according to claim 17, wherein the spring is disposed in the opening of the collar.

19. The device according to claim 17, wherein the spring is arranged substantially parallel to the shank and disposed outside the opening, the spring interacting with an appendage which protrudes extends from the collar.

20. A damping device for furniture comprising:

a pin with an elongated shank configured to be coupled to a first lateral surface of the furniture, wherein the shank is formed of first and second magnet portions coupled diametrically opposite each other and having opposing polarities;

a steel collar configured to be coupled to a second lateral surface of the furniture that slides parallel to the first lateral surface between an open position and a closed position, the collar having an opening for slideably receiving the elongated shank when the first and second lateral surfaces move from the open position to the closed position; and an elastically compressible element arranged to damp movement of the pin, wherein the elastically compressible element compresses as the pin is slideably received in the opening of the elongated shank.

* * * * *